United States Patent [19]

Sugimoto et al.

[11] 4,376,479

[45] Mar. 15, 1983

[54] TOTAL SALES INDICATION DEVICE FOR A VENDING MACHINE

[75] Inventors: Osamu Sugimoto; Masaki Akagawa, both of Sakado, Japan

[73] Assignee: Kabushiki Kaisha Nippon Coinco, Tokyo, Japan

[21] Appl. No.: 196,874

[22] Filed: Oct. 14, 1980

[30] Foreign Application Priority Data

Oct. 16, 1979 [JP] Japan ..... 54-143024[U]

[51] Int. Cl.[3] ..... G07F 9/00

[52] U.S. Cl. ..... 194/1 N; 221/2; 340/825.35; 377/7; 377/14

[58] Field of Search ..... 194/1 L-1 N; 221/2, 7, 8; 222/23, 25, 28, 32; 235/92 AC, 92 CN, 92 ST; 340/825.35, 811, 812; 364/478, 479

[56] References Cited

U.S. PATENT DOCUMENTS

| | | | |
|---|---|---|---|
| 3,756,630 | 9/1973 | Bickford | 222/25 X |
| 4,212,068 | 7/1980 | Hoyt | 222/28 X |
| 4,232,301 | 11/1980 | Nomoto | 235/92 ST X |

*Primary Examiner*—Robert B. Reeves
*Assistant Examiner*—Edward M. Wacyra
*Attorney, Agent, or Firm*—Spensley, Horn, Jubas & Lubitz

[57] ABSTRACT

A vending machine is generally equipped with a money amount indicator which indicates an amount of deposited coins or a balance thereof. This total sales indication device utilizes the money amount indicator to indicate a total sales of the vending machine on this indicator when the vending machine is not making a vending operation. Prices of articles sold are cumulatively added by a sales counter to obtain a total sales and counting contents of this sales counter are indicated on the money amount indicator by manipulating an indication control switch.

9 Claims, 2 Drawing Figures

TOTAL SALES INDICATION DEVICE FOR A VENDING MACHINE

SUMMARY OF THE INVENTION

This invention relates to a total sales indication device for a vending machine.

It is important for a proprietor of a vending machine to know total sales of the vending machine and thereby correctly understand the state of business. There has been a concept of providing a sales indication device including a counter which cumulatively counts sales of a vending machine and a printer which prints out the counted value of the counter. There is, however, a problem that this device requires provision of a printer which increases costs.

It is, therefore, an object of the invention to provide a total sales indication device for a vending machine capable of indicating a total sales which is of a relatively low manufacturing cost. This object is achieved by utilizing for indicating a total sales a money amount indicator already provided in a conventional vending machine for indicating an amount of deposited coins or a balance thereof. When a proprietor or operator of a vending machine checks a total sales, the vending machine normally is not in a vend mode and, accordingly, the money amount indicator is not being used for its proper purpose of indicating an amount of deposited coins or a balance thereof. Therefore, the money amount indicator can be conveniently utilized for indication of a total sales.

The total sales indication device according to the present invention comprises a sales counter for obtaining a total sales by cumulatively counting prices of articles sold, an indication control switch and a control circuit for causing counted contents of the sales counter to be indicated on the money amount indicator in response to manipulation of the indication control switch. In a preferred embodiment of the device made according to the invention, a swtich existing in a conventional vending machine is utilized as the indication control switch and the indication of a total sales is effected by operating this existing switch in a predetermined manner. For instance, arrangements are made so that the switch performs its proper function of indicating an amount of deposited coins etc. when it is depressed once, whereas the swtich performs the function of the indication control switch of the present invention when it is depressed twice. Since a total sales is indicated by utilizing the existing money amount indicator for indicating an amount of deposited coins or a balance thereof, the device according to the invention is advantageous in respect of costs. If an existing switch is utilized as the indication control switch it will further contribute to reduction of costs.

DESCRIPTION OF A PREFERRED EMBODIMENT

Figure 1:
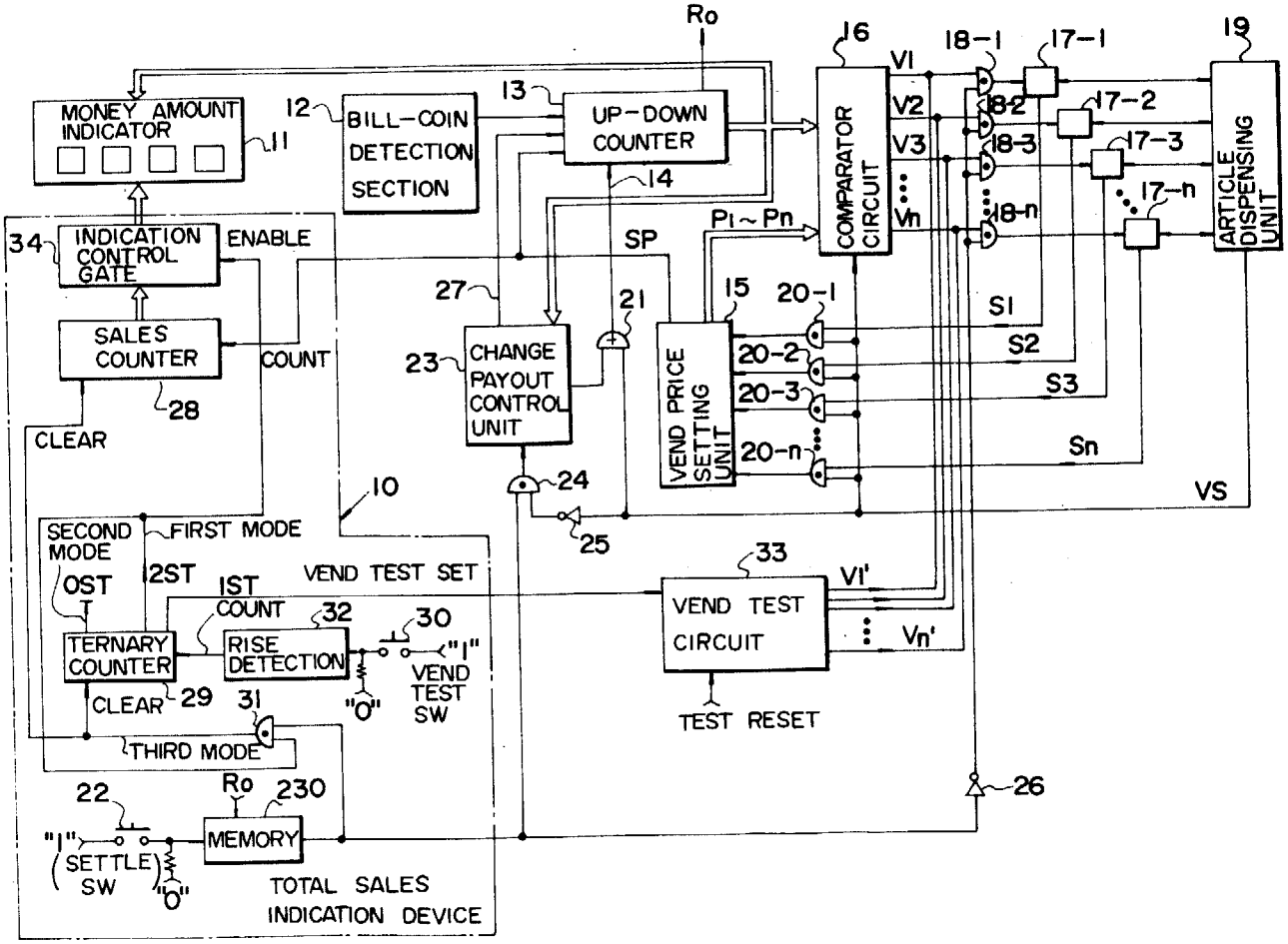
FIG. 1 is a block diagram showing a preferred embodiment of the total sales indication device according to the present invention.

Referring first to FIG. 1, an operation of a vending machine of a common type will be briefly described.

Deposited coin (or bill) is discriminated by denominations by a bill-coin detection section 12. An up-down counter 13 adds amounts of deposited coins together. A signal on an up-down counting control line 14 initially is "0" and the counter 13 is set in an addition mode. Vend prices of all articles which are vendible by the vending machine are set by a vend price setting unit 15. The vend prices setting unit 15 supplies vend price set signal $P_1$–$P_n$ of respective articles to one comparison input of a comparator circuit 16. The comparator circuit 16 receives at another comparison input thereof a counting output of the up-down counter 13. The comparator circuit 16 compares the amount of deposited coins with the vend prices and produces vend possible signals $V_1$–$V_n$ for vendible articles (i.e., articles the vend price of which is equal to or smaller than the amount of deposited coins). The vend possible signals $V_1$–$V_n$ are supplied to an article dispensing unit 19 through AND gates 18-1 through 18-n and signal receiving and delivering circuits 17-l through 17-n. The AND gates 18-1 through 18-n are normally enabled.

The article dispensing unit 19 includes selection switches (not shown) corresponding to the respective articles. If any one of the selection switches corresponding to an article for which the vend possible signel (one of $V_1$–$V_n$) is being produced is depressed, a motor for dispensing the selected article is driven and the selected article is delivered to an article dispensing outlet. Simultaneously, an article selection signal (one of $S_1$–$S_n$) corresponding to the selected article only is supplied from the article dispensing unit 19 to a corresponding one of the signal receiving and delivering circuits 17-1 through 17-n and applied to a corresponding one of the AND gates 20-1 through 20-n. Further, if any one of the selection switches is depressed in the article dispensing unit 19 thereby to bring about a state in which the selected article can be dispensed, a vend start signal VS is produced by the article dispensing unit 19. This vend start signal VS represents that a vending operation (dispensing operation) is being made with respect to any one of the articles.

The vend start signal VS is applied to AND gates 20-1 through 20-n to enable them and also to the up-down counter 13 through an OR gate 21 and the up-down counting control line 14 to bring the counter 13 into a subtraction mode. The vend start signal VS is applied also to the comparator circuit 16 to cancel the vend possible signals $V_1$–$V_n$ and thereby to prevent the comparator circuit 16 from producing its output during a subtraction operation of the up-down counter 13.

As described above, when the article selected by a single operation of the article selection switch is dispensed, one of the article selection signals $S_1$–$S_n$ corresponding to the selected article is applied to the vend price setting unit 15 through one of the AND gates 20-1 through 20-n. The vend price setting unit 15 delivers a pulse SP representing the vend price of the selected article (i.e. the article which is presently being sold) to the up-down counter 13 in response to the article selection signal (one of $S_1$–$S_n$) provided from one of the AND gates 20-1 through 20-n. The counter 13 which is now in the subtraction mode subtracts the price of the article sold from the presently stored count value (i.e. the amount of deposited coins or the balance thereof). Upon completion of dispensing of the selected article (i.e., one cycle of the operation of the motor for dispensing the article), the vend start signal VS is cancelled.

The comparator circuit 16 thereupon is brought into an operable state and produces the vend possible signals $V_1$–$V_n$ in accordance with results of compraison between the contents of the up-down counter 13 representing a balance of the amount of deposited coins and the vend price setting signals $P_1$–$P_n$. In response to production of the vend possible signals $V_1$–$V_n$, vendible articles are indicated by suitable means such, for example, as lighting of lamps. If the purchaser again manipulates an article selection switch for a desired article, the selected article is dispensed to the article dispensing outlet in the same manner as described above, the vend price of the article being subtracted from the balance of the amount of deposited coins.

By the above described repetitive manipulation of the article selection switches and subsequent vending operation, a plurality of articles can be continuously sold. When the purchaser wants to finish purchasing, he manipulates a settle switch 22 to operate a change payout control unit 23. More specifically, upon turning on of the settle switch 22, a signal "1" is stored in a memory circuit 230 and a change payout command signal is supplied from an AND gate 24 to the control unit 23. The AND gate 24 receives at another input thereof a signal produced by inverting the vend start signal VS by an inverter 25, so that the vending machine is brought into a change payout mode not immediately upon turning on of the settle switch 22 during the vending operation but only after finishing of the vending operation (i.e., falling of the vend start signal VS to "0"). The output "1" of the memory circuit 230 is inverted by an inverter 26 and thereby disables all of the AND gates 18-1 through 18-n, prohibiting generation of the vend possible signals $V_1$–$V_n$. The change payout control unit 23 receives the count value of the counter 13 (i.e., the amount to be paid out as change) and pays out coins of an amount equivalent to this count value of the counter 13 in response to the change payout command signal from the AND gate 24. Signals representing the paid out coins are applied to the counter 13 through a line 27. The change payout control unit 23 also supplies a signal "1" instructing the subtraction mode to the counter 13 through the OR gate 21 and the up-down counting control line 14. Accordingly, amounts of coins paid out are successively subtracted in the counter 13 and coins are continuously paid out until contents of the counter 13 are reduced to zero. Upon reducing of the contents of the counter 13 to zero, a reset signal $R_0$ is produced.

The memory circuit 230 is reset by the reset signal $R_0$. If the settle switch 22 is depressed while the reset signal $R_0$ is being produced, the signal "1" is outputted by the memory circuit 230 only during depression of the settle switch 22. It is to be noted that a sales counter 28 and a ternary counter 29 in a total sales indication device 10 to be described later are not reset by the reset signal $R_0$.

The total sales indication device 10 according to the invention will now be described. The vend price SP outputted by the vend price setting unit 15 each time vending of an article is made is applied to the sales counter 28 where a total sales is calculated. The total sales indication device 10 comprises indication control switch means for causing a count value (a total sales) of the sales counter 28 to be indicated by the money amount indicator 11. As this switch means, the present embodiment utilizes a vend test switch 30 and the settle switch 22. An arrangement is made so that when the vend test switch 30 is depressed once, the vending machine is brought into a vend test mode, whereas when the vend test switch 30 is depressed twice, the vending machine is brought into a total sales indication mode (first mode). If the vend test switch 30 is depressed again during the total sales indication mode, a mode in which the total sales indication is cancelled (second mode) is produced. If the settle switch 22 is depressed during the total sales indication mode, a mode in which the count value of the sales counter 28 is cleared (third mode) is produced.

The ternary counter 29 and an AND gate 31 are provided for controlling the above described first through third modes. The output of the vend test switch 30 is applied to a rise detection circuit 32 and one shot of pulse is generated each time the vend test switch 30 is depressed once. This pulse is counted by the ternary counter 29. The ternary counter 29 is a counter which repeats three steps of "0,""1"and "2,""0" being an initial step. Accordingly, the counter is turned to the step "1" by a single depression of the vend test switch 30 by the operator and a signal 1ST representing the step "1" is applied to a vend test circuit 33 as a vend test set signal. Upon being set in a vend test mode by the vend test set signal (1ST), the ven test circuit 33 supplies vend possible signals $V_1'$–$V_n'$ corresponding to all articles to the AND gate 18-1 through 18-n thereby producing a vend possible mode constructively. The operator thereupon can test the condition of the article dispensing unit 19. The vend test circuit 33 is reset when a suitable reset condition is satisfied (e.g. when a coin has been deposited or the settle switch 22 has been depressed or a preset long time has elaspsed from generation of the vend start signal VS).

As the vend test switch 30 is depressed again, the ternary counter 29 is shifted from the step "1" to the step "2" whereupon the indication control gate section 34 is enabled by a signal 2ST representing the step "2." This enables the count value of the sales counter 28 to be supplied to the money amount indicator 11 through the gate section 34 and the total sales is indicated by the money amount indicator 11. The time during which the signal 2ST is present is the "first mode."

If the vend test switch 30 is depressed once again during this first mode, the ternary counter 29 shifted from the step "2" to the step "0." The step "2" signal 2St thereupon is cancelled and the gate section 34 is interrupted with a result that the indication of the total sales is cancelled. In this mode, however, the sales counter 28 is not cleared but maintains storage of the total sales. This is the "second mode."

If the settle switch 22 is depressed during the first mode, the "third mode" is implemented. The step "2" signal 2ST representing the first mode is applied to one input of the AND gate 31 and a signal "1" is applied to another input of the AND gate 31 through the memory circuit 230 when the settle switch 22 has been depressed. Accordingly, the output of the AND gate 31 is "1" during the third mode, thereby clearing the ternary counter 29 to the step "0" and the count value of the sale counter 28 to "0." Accordingly, not only the gate section 34 is interrupted and the indication on the counter 28 is cancelled, but the total sales of the counter 28 is cancelled. The operator implements the first mode and the second mode if he wants to simply confirm the total sales, whereas he implements the first mode and the third mode if he wants to confirm the total sales and thereafter cancel the indication of the total sales.

Figure 2:
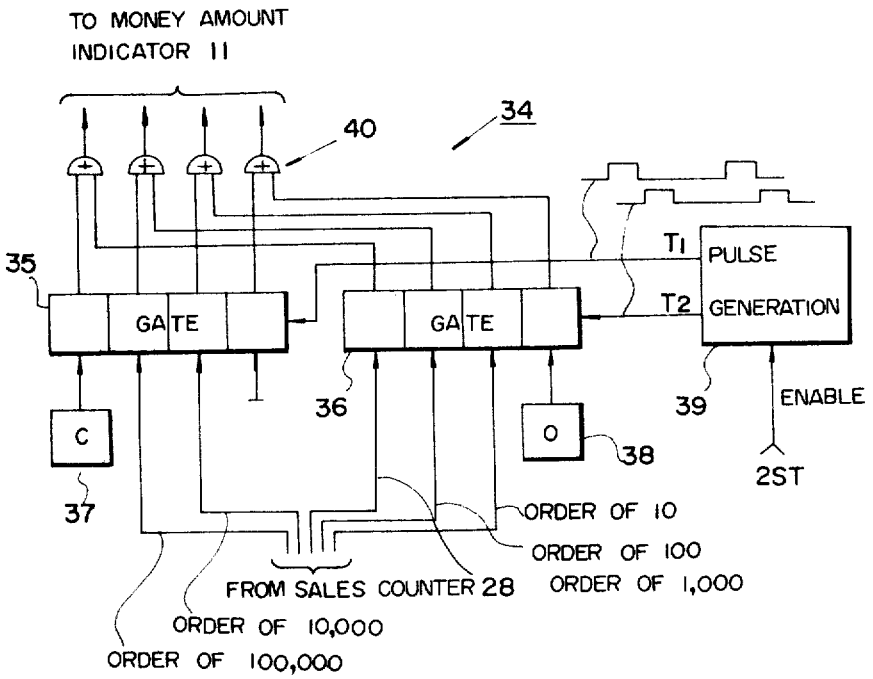
FIG. 2 is a block diagram showing an example of an indication control gate section of FIG. 1

Since the amount of money handled by a single vending is not a large amount, the existing money amount indicator 11 generally employs an indication by four digits in decimal notation. The sale counter, on the other hand, stores a cumulative value of sale of each vending which amounts to a value including a digit which is more significant than the most significant digit (the order of one thousand) of the four digits employed by the money amount indicator 11. According to the present invention, the total sales is divided into two portions and indicated twice, each divided portion being indicated in one indication. For example, the indication control gate section 34 is constructed as shown in FIG. 2 so that an amount of the order to thousand and less and an amount of the order of ten thousand and over are selected on a time shared basis.

The sale counter 28 outputs counted values of the orders of ten, one hundred, one thousand, ten thousand and on hundred thousand (e.g. in the BCD code). The counted values of the orders of ten thousand and one hundred thousand are inputted to positions corresponding to the second and third digits of the gate 35. The count values of the orders of ten, one hundred and one thousand are inputted to positions corresponding to the second, third and fourth digits of the gate 36. Data for indicating a letter "C" is inputted fixedly from a circuit 37 to a position corresponding to the fourth digit of the gate 35 and no indication data is inputted at all to a position corresponding to the first digit of the gate 35. The step "2" signal 2ST outputted by the ternary counter 29(FIG. 1) is applied to an enable input of a pulse generation circuit 39. When the signal 2ST is "1," the pulse generation circuit 39 alternately produces a time division pulses $T_1$ and $T_2$. The gate 35 is opened during appearance of the pulse $T_1$ and the four digit indication data gated out of the gate 35 is applied to the indicator 11 through an OR gate group 40 to be indicated thereon. The gate 36 is opened during appearance of the pulse $T_2$ and the four digit indication data gated out of the gate 36 is indicated on the indicator 11 through the OR gate group 40.

Pulse widths of the pulses $T_1$ and $T_2$ are set to be sufficiently long to enable the human eye to recognize the indication on the indicator 11 and in such a manner that the pulse $T_2$ will rise with some delay after falling of the pulse $T_1$ and the pulse $T_1$ will rise again with some delay after falling of the pulse $T_2$. Accordingly, the amount of the orders of ten thousand and one hundred in the total sales is indicated with the letter C by the indicator 11. At this time, nothing is indicated in the first digit of the indicator 11. Then, the amount of the order of one thousand and lower orders in the total sales is indicated by the indicator 11. The indication in the first digit is fixed to zero. This is for the reason that the minimum unit of the vend price is the order of ten (i.e. 10 yen). According to necessity (e.g. in a case where an outline of the total sales only is required), an arrangement may be made so that an amount of the order of ten thousand and higher order only is indicated.

The present invention is applicable not only to the case where the control circuit for the vending machine is constructed of a fixed circuit as shown in FIG. 1, but also to a case where the control circuit is constructed by utilizing a microcomputer. In the latter case, a program flow chart can be readily made by those skilled in the art from the description made with reference to FIG. 1 so that illustration of such flow chart is omitted.

In the above described description, the vend test switch 30 and the settle switch 22 are utilized as the total sales indication control switch means. The indication control switch means is not limited to this but a switch for an exclusive use for this purpose may be provided. It is, however, apparently more economical to utilize the existing switch. In a case where a switch to be exclusively used for the indication control is provided, modification should be made so that a single depression of the switch produces the first mode. Consequently, a binary counter may be used as the counter 29. It is also possible to add a printer for printing out the counted value of the counter 28 to the total sales indication device 10.

What we claim is:

1. A total sales indication device for a vending machine which includes a money amount indicator for indicating the amount of deposited coins or a balance of such amount, sales counting means for computing the total sales of articles sold by the vending machine and indicator mode control switch means for controlling the indicator mode characterized in that the number of digits in decimal notation of the counting contents of said sales counting means is larger than the number of digits in decimal notation of the indication by said money amount indicator and that said total sales indication device further comprises control means for dividing the digits of the total sales number computed by said sales counting means into a plurality of portions each of which consists of digits the number of which is equal to or smaller than the number of digits of the indication by said money amount indicator, and for causing said money amount indicator to sequentially indicate the digits of the respective portions, in response to manipulation of said indication mode control switch means.

2. A total sales indication device as defined in claim 1 wherein said control means causes the digits of total sales divided into a plurality of portions to be sequentially indicated from the portion of a higher order and causes the portion of the highest order to be identified as such by causing said money amount indicator to indicate a predetermined character in the most significant digit of said money amount indicator in indicating the portion of the highest order.

3. A total sales indication device as defined in claim 1 or 2 wherein said indicator mode control switch means comprises a first switch and a second switch, and said control means implements a first mode in which the counting contents of said sales counting means are indicated by said money amount indicator in accordance with manipulation of said first switch, a second mode in which the indication by said money amount indicator is cancelled by manipulating said first switch again in said first mode, and a third mode in which the counting contents of said sale counting means are cleared and the indication by said money amount indicator is cancelled by manipulating said second switch in said first mode.

4. A total sales indication device as defined in claim 3 wherein said first switch is an existing vend test switch of the vending machine, said control means implements said first mode when said vend test switch is manipulated twice in succession and said second switch is an existing settle switch of the vending machine.

5. A vending machine comprising:

a display having a predetermind number of digit positions, each digit position for displaying a digit;

means for storing a number to be displayed, said number when displayed having a number of digits in excess of the predetermined number of digit positions of the display, wherein the stored number is subdivided into at least two portions and each portion has a number of digits, when displayed, equal to or less than the predetermined number of digit positions of the display; and means coupled to the display and the storing means, for sequentially gating the stored number portions to the display, wherein the stored number portions are sequentially displayed by the same display to indicate the stored number.

6. The vending machine of claim 5, wherein the number stored in the storing means is representative of the total monetary value of the accumulated sales transacted by the vending machine.

7. The vending machine of claim 5 further comprising means for gating an additional character to the display concurrently with at least one of the number portions to mark that number portion when it is displayed.

8. In a vending machine which includes a display having digit positions for displaying the monetary value of deposited coins during a transaction, and a counter for cumulatively adding the prices of articles sold by the vending machine, and for outputting a total sales number representative of the accumulated prices, the improvement comprising gating means coupled to the counter and the display, for sequentially gating portions of the total sales number to the display to sequentially display the total sales number portions, wherein a plurality of display digit positions are utilized first to display a first total sales number portion and at least one of said plurality of digit positions is utilized to subsequently display a second total sales number portion.

9. In a vending machine having a display which has digit positions for displaying the monetary value of deposited coins during a transaction, and a counter for cumulatively adding the prices of articles sold by the vending machine, and for outputting a total sales number representative of the total monetary value of the accumulated sales the improvement comprising:

first and second gates, each gate for gating a plurality of digits to the display when enabled, said plurality of digits not exceeding the number of digit positions of the display, said first gate having a plurality of inputs connected to the counter for gating lower order digits of the total sales number outputted by the counter, and said second gate having a plurality of inputs connected to the counter for gating higher order digits of the total sales number outputted by the counter; and a pulse generator for cyclically and sequentially providing enabling pulses to the first and second gates, wherein the lower order digits and the higher order digits of the total sales number are cyclically and sequentially gated to the display so that the display displays the higher order digits and then displays the lower order digits of the total sales number

* * * * *